US005556701A

United States Patent [19]

Abe et al.

[11] Patent Number: 5,556,701

[45] Date of Patent: Sep. 17, 1996

[54] RECORDING MEDIUM FOR THERMAL TRANSFER RECORDING

[75] Inventors: Kenji Abe; Satoru Sugita, both of Tochigi, Japan

[73] Assignee: Sony Chemicals Corporation, Tokyo, Japan

[21] Appl. No.: 365,573

[22] Filed: Dec. 28, 1994

[30] Foreign Application Priority Data

Dec. 28, 1993 [JP] Japan ..... 5-337259

[51] Int. Cl.[6] ..... B41M 5/40

[52] U.S. Cl. ..... 428/336; 428/195; 428/480; 428/484; 428/488.1; 428/500; 428/913; 428/914

[58] Field of Search ..... 428/195, 484, 428/488.1, 488.4, 913, 914, 480, 500, 336

[56] References Cited

FOREIGN PATENT DOCUMENTS 60-165291 8/1985 Japan ..... 428/195

*Primary Examiner*—Bruce H. Hess
*Attorney, Agent, or Firm*—Hill, Steadman & Simpson

[57] ABSTRACT

A recording medium for thermal transfer recording includes a backing, a primer layer and ink layer. The primer layer is formed on the backing. The ink layer containing a thermally fusible material is formed on the primer layer. The primer layer contains caprolactone oligomer with its number-average molecular weight of 10000 or less.

7 Claims, No Drawings

RECORDING MEDIUM FOR THERMAL TRANSFER RECORDING

BACKGROUND OF THE INVENTION

The present invention relates to a recording medium for thermal transfer recording for use in a thermal transfer recording system printer or the like, for example.

Recently, there are widely used thermal transfer recording system printers which have advantages, such as easy maintenance and small noise.

A recording medium for thermal transfer recording used in this system has a film-shaped backing and an ink layer on the film-shaped backing in which the ink can be recorded on a transferred material, such as paper, plastic film or the like, with application of heat generated from a thermal head..

The ink layer of the recording medium for thermal transfer recording of this kind is made of a thermally fusible material which is mainly made of a wax and so on having small polarity. Therefore, there is then the disadvantage that the above-mentioned ink layer cannot satisfactorily adhere to the film made of a plastic having high polarity, such as polyester, polyimide, or polycarbonate.

Therefore, when such recording medium for thermal transfer recording is loaded into a printer, it is sometimes observed that because the backing is wrinkled or folded, the ink layer is detached from the backing and the ink is trailed from a printed portion during printing (this phenomenon will hereinafter be referred to as a trail of the ink, in which the ink layer is transferred to not only a target transferred portion but also a succeeding portion thereof).

Recently, it is proposed that a primer layer is formed between the backing and the ink layer to increase adhesion therebetween.

However, the proposed recording medium having the primer layer is encountered by the following problems.

Indeed, when a resin primer is used, the adhesion between the backing and the ink layer is improved. But, when printing is carried out at high speed and at high temperature, e.g., at 40° C., it is sometimes observed that a sticking and a jerky printing, both of which will be described later, are caused. The sticking is a phenomenon in which the ink layer is transferred to the transferred object but is not detached from the backing with the result that the transferred object and the recording medium for thermal transfer recording are integrally conveyed and wound around a takeup shaft. The jerky printing is a phenomenon in which when the ink layer is not detached from the backing smoothly, i.e., when the ink layer is detached therefrom intermittently, a recorded object includes a blank line portion formed in the direction perpendicular to the direction in which the recorded object and the recording medium are conveyed.

Surveyance of the inventors of the present invention reveals that the above phenomena are caused by the following cause.

Specifically, printing is carried out by detaching the ink layer from the backing. High printing speed is equivalent to high detachment speed in rheological terminology. As a result of high detachment speed, intensive detaching force between the ink layer and the backing is required for printing at high speed, so that the ink layer is not detached from the backing to thereby cause the sticking and the jerky printing.

At high ambient temperature, resin of the primer layer becomes soft and adsorbs the ink of the ink layer well, so that cohesive failure in the primer layer should be caused to transfer the ink layer. Therefore, intensive detaching force is required for detaching the ink layer from the backing. As described above, with the above recording medium, when printing is carried out at high speed and in a high ambient temperature, smooth printing could not be carried out.

SUMMARY OF THE INVENTION

In view of such aspects, an object of the present invention is to provide a recording medium for thermal transfer recording with which smooth printing can be carried out at high speed and in a high ambient temperature.

The recording medium for thermal transfer recording according to the present invention is a recording medium for thermal transfer recording comprising a backing, a primer layer and an ink layer containing a thermally fusible material which is formed on the backing through the primer layer. The primer layer of the recording medium for thermal transfer recording according to the present invention contains caprolactone oligomer having its number-average molecular weight of less than 1000.

The backing according to the present invention can be formed of a plastic film which is usually used in the recording medium for thermal transfer recording of this kind, such as polyester film, polyimide film, polysulfone film, polypropylene film, and polycarbonate film. The backing according to the present invention can be also formed of a condenser film.

The primer layer according to the present invention contains the caprolactone oligomer. The caprolactone oligomer is obtained by polymerizing cyclic ester monomer having the following chemical structural formula:

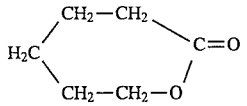

The caprolactone oligomer can be made of a derivative, such as caprolactonediol and caprolactonetriol which are generated by modifying other organic compounds.

The caprolactone oligomer can be used in the primer layer according to the present invention in the form of a single compound or its mixture having two compounds or more. It is desirable to set the number-average molecular thereof equal to or smaller than 10000. If the number-average molecular thereof exceeds the above value, then the ink layer is detached from the backing without cohesive failure in the primer layer to thereby cause the sticking and the jerky printing.

The primer layer according to the present invention can properly and selectively be mixed with a thermally fusible material such as a wax, a thermoplastic material, a tackifier, a softener and so on for the purpose of adjusting viscosity of the primer layer and further for another purposes, such as adjusting the detaching force and transferring the ink layer satisfactorily, for example. The primer layer should contain the caprolactone oligomer of an amount equal to or greater than 30% thereof. If a content of the caprolactone oligomer is smaller than 30% thereof, then it is difficult to achieve the effects of the present invention.

It is desirable to select the above thermally fusible material such as the wax and so on from a group of carnauba wax, candelilla wax, polyethylene wax, paraffin wax, microcrystalline wax, fatty acid ester, fatty acid amide and so on, for example.

It is desirable to select the above thermoplastic material from a group of polyester resin, acrylic resin, terpene resin, styrene resin, rosin resin, petroleum resin, rubber resin and so on, for example. The thermoplastic material can be added with a coloring agent such as a pigment or a dye, a filler and so on.

The primer layer is formed such that its thickness ranges from 0.2 to 1.5 μm, preferably from 0.5 to 1.0 μm. If the thickness of the primer layer is smaller than 0.2 μm, then the cohesive failure in the primer layer, which is one of the effects of the present invention, is not caused. If the thickness thereof is greater than 1.5 μm, then since the whole recording medium for thermal transfer recording is increased in thickness, it is increased in stiffness and becomes brittle to thereby detach the ink layer from the backing with ease.

The ink layer according to the present invention is formed of a known thermally fusible layer which contains a coloring agent, a wax and resin as its main components.

To transfer the ink layer with lower energy, it is desirable to provide an overcoat layer on the ink layer. The overcoat layer can be made of a wax, such as carnauba wax, paraffin wax and beeswax, and thermoplastic resin such as polyethylene, polyamide, polyester, ketone resin, acrylic resin and so on. The overcoat layer can be added with a coloring agent such as a pigment or a dye, a filler and so on.

It is possible to provide a heat-resistant lubricant layer on a surface of the backing, where the ink layer is not formed, in order to prevent the recording medium from sticking to the recorded object and to convey the recording medium smoothly. The heat-resistant lubricant layer can be made of resin having excellent heat resistance, such as silicone resin, fluororesin and nitrocellulose, or one of these resins which contains a lubricant such as silicone oil and fluorine powder.

DESCRIPTION OF THE PREFERRED EMBODIMENTS

A recording medium for thermal transfer recording according to the present invention will be described in detail with reference to concrete examples.

Inventive Example 1

Formation of a Primer Layer

Caprolactonediol (manufactured by DAICEL CHEMICAL INDUSTRIES, LTD. under the trade name of Placcel 220) having its number-average molecular weight of 2000 was used as caprolactone oligomer. After caprolactonediol of 10 parts by weight was added with toluene of 90 parts by weight, which was a volatile solvent, and dissolved therein to obtain a solution, the solution was coated by a gravure coater on a surface, which was not made heat-resistant, of a polyester film (manufactured by TEIJIN LTD.) With its thickness of 6 μm which was made heat resistant. Toluene was evaporated to obtain a dry paint film as the primer layer. A thickness of the primer layer measured after evaporation of toluene was 1 g/m$^2$.

Formation of ink layer

Subsequently, after carnauba wax (manufactured by NODA WAX CO., LTD. under the trade name of Carnauba No. 2) of 8 parts by weight, paraffin wax (manufactured by NIPPON SEIRO CO., LTD. under the trade name of HNP-3) of 8 parts by weight, copolymer of ethylene and vinyl acetate (SUMITOMO CHEMICAL CO., LTD. under the trade name of KA-31) of 1 part by weight and carbon black (manufactured by Mitsubishi Kasei Corp. under the trade name of MA-100) of 3 parts by weight were dissolved and dispersed in toluene of 90 parts by weight to obtain a solution, the solution was coated on the above primer layer by the gravure coater. Toluene was evaporated to form a dry coat film as the ink layer. Thus, a target recording medium for thermal transfer recording was manufactured. A thickness of the recording medium for thermal transfer recording measured after evaporation of toluene was 3 g/m$^2$.

Evaluation Method

The obtained recording medium for thermal transfer recording was evaluated under the following conditions with respect to the following items.

1. Printing speed

When printing was carried out at a speed of 2.3 inch/sec, a bar-code printer (manufactured by AUTONICS CO., LTD under the trade name of BC-8 MK-II) was used. When printing was carried out at a speed of 6 inch/sec, a bar-code printer (manufactured by SATO CO., LTD under the trade name of M-8450) was used.

2. Ambient temperature

When the printing speed was 2.3 inch/sec, the obtained recording medium was evaluated at both room temperature (25° C.) and 40° C. When the printing speed was 6 inch/sec, the obtained recording medium was evaluated only at room temperature (25° C.). In this evaluation, each of the above temperatures was a temperature around the printer measured when printing was continuously carried out.

3. Evaluation items (1) When the sharp printing was carried out without the sticking, the jerky printing and the trail, the recording medium was evaluated with an open circle. When the sharp printing was not carried out, the recording medium was evaluated with a cross.

(2) A gloss of the printed object was evaluated by directly watching a surface of the printed object. When the cohesion failure was caused in the primer layer, the surface was mat.

Evaluated results are shown in Tables 1 through 3.

Inventive example 2

When the primer layer was formed, caprolactonediol with its number-average molecular weight of 4000 (manufactured by DAICEL CHEMICAL INDUSTRIES, LTD. under the trade name of Placcel 240) of 10 parts by weight was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables 1 through 3.

Inventive Example 3

When the primer layer was formed, caprolactone oligomer with its number-average molecular weight of 10000 (manufactured by DAICEL CHEMICAL INDUSTRIES, LTD. under the trade name of Placcel H1-P) of 10 parts by weight was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables 1 through 3.

Inventive Example 4

When the primer layer was formed, caprolactonetriol with its number-average molecular weight of 2000 (manufactured by DAICEL CHEMICAL INDUSTRIES, LTD. under the trade name of Placcel 320) of 10 parts by weight was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables 1 through 3.

Inventive Example 5

When the primer layer was formed, caprolactone oligomer with its number-average molecular weight of 10000 (manufactured by DAICEL CHEMICAL INDUSTRIES, LTD. under the trade name of Placcel H1-P) of 3 parts by weight was mixed with polyester resin (manufactured by TOYOBO CO., LTD. under the trade name of VYLON 200) of 7 parts by weight. This mixture was added with methyl ethyl ketone, which is a volatile solvent, of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables 1 through 3.

Inventive Example 6

When the primer layer was formed, caprolactone oligomer with its number-average molecular weight of 10000 (manufactured by DAICEL CHEMICAL INDUSTRIES, LTD. under the trade name of Placcel H1-P) of 3 parts by weight was mixed with carnauba wax (manufactured by NODA WAX CO., LTD. under the trade name of CARNAUBA No. 2) of 7 parts by weight. This mixture was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables 1 through 3.

Inventive Example 7

When the primer layer was formed, caprolactonediol with its number-average molecular weight of 2000 (manufactured by DAICEL CHEMICAL INDUSTRIES, LTD. under the trade name of Placcel 220) of 3 parts by weight was mixed with carnauba wax (manufactured by NODA WAX CO., LTD. under the trade name of CARNAUBA No. 2) of 7 parts by weight. This mixture was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables 1 through 3.

Inventive Example 8

When the primer layer was formed, caprolactone oligomer (manufactured by DAICEL CHEMICAL INDUSTRIES, LTD. under the trade name of Placcel H1-P) of 6.6 parts by weight and caprolactonediol (manufactured by DAICEL CHEMICAL INDUSTRIES, LTD. under the trade name of Placcel 240) of 3.3 parts by weight were mixed (i.e., they were mixed in proportion of 2:1) to obtain caprolactone oligomer with its number-average molecular weight of 8000 of 10 parts by weight, which was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables 1 through 3.

Comparative Example 1

When the primer layer was formed, polyester resin (manufactured by TOYOBO CO., LTD. under the trade name of VYLON 200) of 2 parts by weight was added with toluene of 98 parts by weight and dissolved therein. The succeeding processes of manufacturing a target recording medium were the same as those of inventive example 1. The obtained recording medium was evaluated similarly to that of inventive example 1 and its evaluated results were shown in Tables 1 through 3.

Comparative Example 2

When the primer layer was formed, carnauba wax (manufactured by NODA WAX CO., under the trade name of CARNAUBA No. 2) of 9 parts by weight and copolymer of ethylene and vinyl acetate (manufactured by SUMITOMO CHEMICAL CO., LTD. under the trade name of KA-31) of 1 part by weight were mixed. This mixture of 10 parts by weight was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables 1 through 3.

Comparative Example 3

When the primer layer was formed, caprolactone oligomer with its number-average molecular weight of 100000 (manufactured by DAICEL CHEMICAL INDUSTRIES, LTD. under the trade name of Placcel B7) of 10 parts by weight was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables 1 through 3.

Comparative Example 4

When the primer layer was formed, caprolactone oligomer (manufactured by DAICEL CHEMICAL INDUSTRIES, LTD. under the trade name of Placcel H1-P) of 6.6 parts by weight and caprolactone oligomer (manufactured by DAICEL CHEMICAL INDUSTRIES, LTD. under the trade name of Placcel H4) of 3.3 parts by weight were mixed (i.e., they were mixed in proportion of 2:1) to obtain caprolactone oligomer with its number-average molecular weight of 20000 of 10 parts by weight, which was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in TABLES 1 THROUGH 3.

COMPARATIVE EXAMPLE 5

When the primer layer was formed, caprolactone oligomer with its number-average molecular weight of 40000 (manufactured by DAICEL CHEMICAL INDUSTRIES, LTD. under the trade name of Placcel H4) of 10 parts by weight was added with toluene of 90 parts by weight and dissolved therein. A target recording medium for thermal transfer recording was manufactured in the same succeeding processes as those of inventive example 1. The obtained recording medium was evaluated similarly to that of inventive example 1 and its evaluated results were shown in Tables. 1 through 3.

TABLE 1

| | composition of primer layer | | |
|---|---|---|---|
| | caprolactone oligomer (parts by weight) | viscosity adjusting agent or resin other than caprolactone oligomer (parts by weight) | volatile solvent (toluene) (parts by weight) |
| inventive example 1 | 10*1 | 0 | 90 |
| inventive example 2 | 10*2 | 0 | 90 |
| inventive example 3 | 10*3 | 0 | 90 |
| inventive example 4 | 10*4 | 0 | 90 |
| inventive example 5 | 3*3 | 7*5 | 90 (MEK) |
| inventive example 6 | 3*3 | 7*6 | 90 |
| inventive example 7 | 3*1 | 7*6 | 90 |
| inventive example 8 | 10*7 | 0 | 90 |
| comparative example 1 | 0 | 2*5 | 98 |
| comparative example 2 | 0 | 10*8 | 90 |
| comparative example 3 | 10*9 | 0 | 90 |
| comparative example 4 | 10*10 | 0 | 90 |
| comparative example 5 | 10*11 | 0 | 90 |

*1: Placcel 220 (manufactured by DAICEL CHEMICAL INDUSTRIES, LTD.)
*2: Placcel 240 (manufactured by DAICEL CHEMICAL INDUSTRIES, LTD.)
*3: Placcel H1-P (manufactured by DAICEL CHEMICAL INDUSTRIES LTD.)
*4: Placcel 320 (manufactured by DAICEL CHEMICAL INDUSTRIES, LTD.)
*5: Vylon 200 (polyester resin manufactured by TOYOBO CO., LTD)
*6: Carnauba 2 (carnauba wax manufactured by NODA WAX CO., LTD.)
*7: Placcel H1-P, manufactured by DAICEL CHEMICAL INDUSTRIES, LTD. of 6.6 parts by weight and Placcel 240 (manufactured by DAICEL CHEMICAL INDUSTRIES, LTD.) of 3.3 parts by weight
*8: Carnauba 2 (carnauba wax manufactured by NODA WAX CO., LTD.) of 9 parts by weight and AL-31 (copolymer of ethylene acetate and vinyl manufactured by SUMITOMO CHEMICAL CO., LTD) of 1 part by weight
*9: Placcel H7 (manufactured by DAICEL CHEMICAL INDUSTRIES, LTD.)
*10: Placcel H1-P (manufactured by DAICEL CHEMICAL INDUSTRIES, LTD.) of 6.6 parts by weight and Placcel H4 (manufactured by DAICEL CHEMICAL INDUSTRIES, LTD.) of 3.3 parts by weight
*11: Placcel H4 (manufactured by DAICEL CHEMICAL INDUSTRIES, LTD.

TABLE 2

| | composition of primer layer | | |
|---|---|---|---|
| | number-average molecular weight of caprolactone oligomer (parts by weight) | melting point of caprolactone oligomer (°C.) | thickness of coated film ($g/m^2$) |
| inventive example 1 | 2000 | 53 to 55 | 1.0 |
| inventive example 2 | 4000 | 55 to 58 | 1.0 |
| inventive example 3 | 10000 | 60 | 1.0 |
| inventive example 4 | 2000 | 40 to 45 | 1.0 |
| inventive example 5 | 10000 | 60 | 0.5 |
| inventive example 6 | 10000 | 60 | 1.0 |
| inventive example 7 | 2000 | 53 to 55 | 1.0 |
| inventive example 8 | 8000 | 60 | 1.0 |
| comparative example 1 | — | — | 0.1 |
| comparative example 2 | — | — | 1.0 |
| comparative example 3 | 100000 | 60 | 1.0 |
| comparative example 4 | 20000 | 60 | 1.0 |
| comparative example 5 | 40000 | 60 | 1.0 |

TABLE 3

| | results of printing | | |
|---|---|---|---|
| | room temperature (25° C.) | | high ambient temperature (40° C.) |
| | low speed | high speed | low speed |
| inventive example 1 | ○ | ○ | ○ |
| inventive example 2 | ○ | ○ | ○ |
| inventive example 3 | ○ | ○ | ○ |
| inventive example 4 | ○ | ○ | ○ |
| inventive example 5 | ○ | ○ | ○ |
| inventive example 6 | ○ | ○ | ○ |
| inventive example 7 | ○ | ○ | ○ |
| inventive example 8 | ○ | ○ | ○ |
| comparative example 1 | X | X | X |
| comparative example 2 | X | X | X |
| comparative example 3 | X | X | ○ |
| comparative example 4 | X | X | X |
| comparative example 5 | X | X | X |

As clear from Tables 1 through 3, when the recording media of inventive examples 1 through 8 each using the caprolactone oligomer with its number-average molecular weight of 10000 or less as the primer layer thereof were used, the sticking, the jerky printing and the trailing were not caused and the ink layer could sharply be transferred regardless of printing speeds and ambient temperatures. The surface of the object printed by using each of the recording media was matted, which reveals that the cohesive failure was caused in the primer layer.

On the other hand, when the recording media of comparative examples 1 through 5 which do not use the caprolactone oligomer with its number-average molecular weight of 10000 or less as the primer layer were used and when the recording media of comparative examples 3 through 5 each using the caprolactone oligomer with its number-average molecular weight of more than 10000 as the primer layer were used, satisfactory printing could not be carried out in any case.

As described above, according to the present invention, since the primer layer of the recording medium for thermal transfer recording contains the caprolactone oligomer with its number-average molecular weight of 10000 or less, the printing on the object can be achieved smoothly and sharply even at high speed and in high ambient temperature. As a result, there can be provided the recording medium for thermal transfer recording which can be used in the printer for printing objects under various conditions.

According to the present invention, since the primer layer contains the caprolactone oligomer with its number-average molecular weight of 10000 or less, the above effects can be achieved reliably.

According to the present invention, since the primer layer contains the thermoplastic material and/or the thermally fusible material, the viscosity of the primer layer can properly be adjusted and, moreover, the recording medium can be improved in transfer without the ink layer being detached from the recording medium and/or without lowering the melting point of the ink layer.

According to the present invention, since the thickness of the primer layer is set in the range from 0.2 to 1.5 μm, preferably from 0.5 to 1.0 μm, the ink layer can be prevented from being detached from the recording medium for thermal transfer recording and when the thermal transfer is carried out, the cohesive failure can be caused in the primer layer. Therefore, sharp printing can be carried out.

Having described preferred embodiments of the present invention with reference to the accompanying drawings, it is to be understood that the present invention is not limited to those precise embodiments and that various changes and modifications can be effected therein by one skilled in the art without departing from the spirit or scope of the present invention as defined in the appended claims.

What is claimed is:

1. A recording medium for thermal transfer recording comprising:

a backing;

a primer layer provided on said backing; and a thermally fusible ink layer provided on said primer layer, wherein said primer layer comprises a caprolactone oligomer having a number-average molecular weight of 10000 or less.

2. A recording medium for thermal transfer recording according to claim 1, wherein said caprolactone oligomer in said primer layer is present in an amount equal to or greater than 30%.

3. A recording medium for thermal transfer recording according to claim 1, wherein said primer layer further comprises a thermoplastic material selected from the group consisting of polyester resin, acrylic resin, terpene resin, styrene resin, rosin resin, petroleum resin, and rubber resin.

4. A recording medium for thermal transfer recording according to claim 1, wherein said primer layer further comprises a thermally fusible material selected from the group consisting of carnauba wax, candelilla wax, polyethylene wax, paraffin wax, microcrystalline wax, fatty acid ester and fatty acid amide.

5. A recording medium for thermal transfer recording according to claim 1, wherein said primer layer has a thickness ranging from 0.2 to 1.5 μm.

6. A recording medium for thermal transfer recording according to claim 1, wherein said primer layer has a thickness ranging from 0.5 to 1.0 μm.

7. A recording medium for thermal transfer recording according to claim 1, wherein said backing has a heat-resistant lubricant layer disposed on its other surface.

* * * * *